US005082433A

United States Patent [19]

Leithner

[11] Patent Number: 5,082,433

[45] Date of Patent: Jan. 21, 1992

[54] METHOD FOR PRODUCING A CAM

[75] Inventor: Karl Leithner, Rankweil, Austria

[73] Assignee: Etablissement Supervis

[21] Appl. No.: 629,230

[22] Filed: Dec. 17, 1990

[30] Foreign Application Priority Data

Dec. 20, 1989 [DE] Fed. Rep. of Germany ..... 3942091

[51] Int. Cl.[5] ..... B22F 1/00

[52] U.S. Cl. ..... 419/11; 419/26; 419/29; 419/36; 419/57; 75/244; 75/246

[58] Field of Search ..... 75/246, 244; 919/11, 919/26, 29, 38, 59

[56] References Cited

U.S. PATENT DOCUMENTS 4,664,706 5/1987 Drozda ..... 419/38

*Primary Examiner*—Stephen J. Lechert, Jr.
*Attorney, Agent, or Firm*—Toren, McGeady & Associates

[57] ABSTRACT

Molded articles, particularly cams for camshafts of internal combustion engines, are subjected to high wear conditions. In order to make them resistant to wear, they are produced from a sintered alloy, which has been fabricated by powder metallurgical means. The alloy has a hardened matrix with interstitial copper and consists of 0.5 to 16% by weight of molybdenum, 1 to 20% by weight of copper, 0.1 to 1.5% by weight of carbon and, optionally, of admixtures of chromium, manganese, silicon and nickel totalling, at most, 5% by weight, the remainder being iron.

12 Claims, 1 Drawing Sheet

METHOD FOR PRODUCING A CAM

BACKGROUND OF THE INVENTION

This invention is directed to a molded article, more particularly to a cam of a sintered powder metallurgically produced alloy for a camshaft for internal combustion engines, which is assembled according to the modular principle, as well as to a method for its production.

Throughout the specification, the numbers inside parentheses refer to publications numbered according to a list which is appended to this application.

The cams of camshafts of internal combustion engines are exposed to very heavy wear. To fulfill their task of controlling the engine, the wear during the whole of their service life should not exceed more than a few microns. In this connection, they must also withstand load cycles while insufficiently lubricated. The conventional method in the literature and in industry is the use of alloys with a high carbide content, which are produced either by powder metallurgical means from appropriate materials or by rapidly quenching cast iron. By these means, the abrasive, as well as the adhesive wear can be kept within limits.

Aside from mechanical stresses, cams are also subjected to thermal stresses. For this reason, the nature of the cams must be such that they maintain their hardness even after prolonged annealing. This can be achieved by hardening and subsequently annealing at a temperature above the operating temperature. Even under operating conditions at which deficient lubrication occurs and which promote adhesive wear, the cams must exhibit excellent operating behavior.

For some years now, particularly since camshafts assembled according to the modular system have come into vogue for internal combustion engines (1, 2), the debate about the wear in the cam counterbody system has intensified. Aside from references to the fact that wear in this system is very sensitive to and depends on lubrication (3) and the finishing by grinding or superfinishing (4, 5), there is a large number of publications, which attempt to solve the problem on the basis of material development.

For a promising start, it is first of all necessary to analyze the wear problems of this system. It has been pointed out in numerous publications (3, 6, 7) that wear makes its appearance above all as polishing wear, pitting and scoring.

Polishing wear is one form in which abrasive wear appears. By using appropriately fine abrasives, a very small amount is removed and the grooves formed are very small. The cam, so worn, appears to be brightly polished, the roughness of the worn regions generally being significantly less than that of the undamaged (ground) regions. The polishing wear can be caused as 3-body wear by quartz dust in the oil. Sand is one of the most frequently occurring abrasive materials in technology. Since polishing wear also occurs under experimental conditions, for which contamination of the oil can be excluded, there must also be yet another mechanism. Polishing wear can obviously also be aided by a rough counter-body, which contains no carbide.

Pitting is a consequence of surface fatigue. The dynamic pressure load on the cam surface, which is the result of the kinematics, can lead to local fissure spreading. These fissures extend below the surface and run together with other fissures or emerge again from the surface. A consequence is the formation of relatively large wear particles and small pits on the surface. This wear phenomenon can be furthered by additives in the oil (3), if the additives facilitate the spread of the fissures, for example, by decreasing the surface energy.

Scoring is a consequence of adhesive wear, that is, the mutual welding of surfaces. It is favored by the use of martensitic parent substances and counter-objects (8) and through the use of plain oil. Experiments with increased springiness of the valve spring also favor scoring. Of 43 pairings, 26 failed due to scoring when plain oil was used. On the other hand, not a single pairing failed due to scoring when doped oil was used (8). As against this, failure due to pitting increased from 17 pairings to 35 pairings for doped oil (8).

Despite the frequent occurrence of pitting, less attention is paid to this wear phenomenon in investigations than to the other two. In principle, pitting itself does not affect the function of the cam (6). However, it decreases the bearing surfaces, so that the surface pressure increases, as a result of which failure due to scoring can be caused. Moreover, the pitting tendency can readily be recognized in short term tests with an increased load (7), while the results of polishing and scoring wear can be extrapolated only with extreme care (8, 9). Pitting therefore is not critical, as long as it occurs only to a slight extent. Moreover, it can be simulated easily in experiments.

Most publications are concerned with avoiding scoring wear and polishing wear. Moreover, all experiments aim at producing materials with a high proportion of carbide (2, 6, 8, 9, 10, 11, 12, 13). Due to their high hardness, carbides decrease the depth of penetration of the counter-body. By these means, the size of the wear particles and, with that, the possible rate of wear is reduced (14). The second effect is due to the low tendency to adhere, which is exhibited by the carbides. If the carbides constitute a sufficiently large proportion by volume, adhesion wear is avoided completely. Attempts to reduce cam wear by a solid lubricant, which is embedded in the cam, are not known.

The embedding of lubricants in sintered alloys has been used for a long time, in order to produce a self-lubricating bearing (15). For example, lead, which was introduced by impregnating it in a relatively complex alloy (Fe-Co-Mo-Ni-Cr-Si-C), is used. This alloy has proven its value when used in valve seats in internal combustion engines (16).

There has already been much discussion in the literature of copper as an alloying element, because it is an easily processed element (its oxygen potential is significantly less than that of iron). The mechanical properties (17, 18) or the dimensional behavior (19, 20), as well as homogenization (21) are discussed frequently. In conventional steel technology, copper is known as a material harmful to steel, since it promotes the tendency to develop red-shortness (22). In powder metallurgical manufacture, however, this type of failure does not play a role, as long as the molded articles do not have to be converted by sinter forging.

The effect of copper on the wear of sintered iron is significantly less than the effect of the density, at least when copper is admixed in amounts of 0 to 2% (23). Samples of different density were investigated in the Amsler Tribometer (two cylinders rolls with a slippage of 10% relative to one another). The atmosphere (air, argon or oxygen) has a decisive effect on the amount of wear. Wear in an oxygen atmosphere is greater by a factor of 72 than wear in an atmosphere of air. Since the wear under argon lies between the two values, it is very likely that water vapor has an effect in the experiments. The sintering conditions, which take place at 1120° C., lead to the assumption that the copper is dissolved completely in the matrix.

The effect of admixing copper in amounts of 0 to 4% in various phosphorus containing sintered steels was also investigated (24). In the more highly alloyed variants (4% Mo, 4% Ni or 4% MCM, a master alloy of molybdenum, chromium and manganese), an addition of copper causes a decrease in the wear in the pin-disk test. In the less highly alloyed variants, the addition of copper has a relatively unsystematic effect. The effect of the copper is based on hardening the matrix. Although the sintered density decreases with increasing copper content, the hardness increases continuously with the increasing copper content. Because of the increase in hardness, it can be assumed that the copper is dissolved completely in the matrix. The decrease in density is also an indication of this. Copper leads to a decrease in density during sintering, if it is dissolved in the matrix and if pores remain behind in those places in which the copper was originally present.

The combination of a binding phase of copper, manganese or nickel or combinations thereof with very hard super-speed steel particles has also already been investigated (25). The structure, so produced, is more ductile than pure super-speed steel and has proven its value for applications in which there is wear.

In many other investigations (26, 27, 28, 29), copper serves as a model material for fundamental investigations. The finding that the rate of wear of copper when sliding dry against iron is less than that of nickel by a factor of 5, seems remarkable (28). This result indicates the slight tendency of copper-iron pairings to adhere and the good emergency running properties of copper, which are associated with this.

Molybdenum is to be found in very many P/M steels. The reason for the frequent use of 0.5% molybdenum is surely strictly practical in nature. A basic iron powder containing 0.5% molybdenum is commercially available. The deliberate admixture occurs in only the most infrequent of cases. Fe-P-Cu-Mo alloys with copper contents of up to 4% and molybdenum contents of 2% and 4% were also investigated (17). All alloying components were mixed in as elements. After a 1-hour sintering process at 1200° C., the samples with 2% of molybdenum and 4% of copper had an irregular 2-phase structure. This inhomogeneity becomes even clearer if the molybdenum content is increased to 4%. Carbon retards the diffusion of Cu in Fe, but does not prevent the complete dissolution.

Numerous attempts to control the wear in the cam/-counter object system are known. Up to now, all of them have been based on producing a carbide rich structure.

SUMMARY OF THE INVENTION

The principal object of the invention is to improve the emergency running properties of a cam, starting out from the above state of the art. Other objects will become apparent from the description below.

According to the invention, the objective is accomplished by means of an alloy which has a hardened matrix with interstitial copper and consists of 0.5 to 16% by weight of molybdenum, 1 to 20% by weight of copper, 0.1 to 1.5% by weight of carbon and, optionally, further consists of admixtures of chromium, manganese, silicon and nickel totalling at most 5% by weight, the remainder being iron. The admixtures are used in order to adapt the alloy to the application with respect to secondary hardness, deformation hardening and the ability to through-harden.

The method of producing such a cam comprises pressing a sintering powder into a molded cam with a green density of more than 7 g/cc, wherein the sintering powder consists of 0.5 to 16% by weight of molybdenum, 1 to 20% by weight of copper, 0.1 to 1.5% by weight of carbon and, optionally, further consists of admixtures of chromium, manganese, silicon and nickel totalling at most 5% by weight, the remainder being iron, sintering the molded cam at a temperature below 1150° C. for a period of 10 to 60 minutes and subsequently hardening and tempering the sintered cam.

EXAMPLE

A powder mixture with 1.5% by weight molybdenum, 10% by weight of copper, 0.8% by weight of carbon, the rest being iron, was prepared on the basis of a prealloyed powder of iron and molybdenum. The cam with a green density of 7.2 g/cc was prepared by pressing at a pressure of 1,500 MPa. The structure was consolidated by sintering at 1120° C. for 30 minutes. By means of a subsequent hardening and tempering by annealing at 930° C. for 60 minutes, quenching in oil and tempering at 150° C. for 60 minutes, a structure was produced, which had a surface hardness of 44.4 Rockwell hardness C (793 Vicker's hardness I). This high level of hardness was achieved, although more than 7% by volume of the structure consisted of elementary copper. On the test bench, the cams proved to be exceptionally wear resistant. The cams exhibited exceptional operating behavior even under conditions, at which deficient lubrication occurred and which therefore promote adhesive wear.

Figure 1:
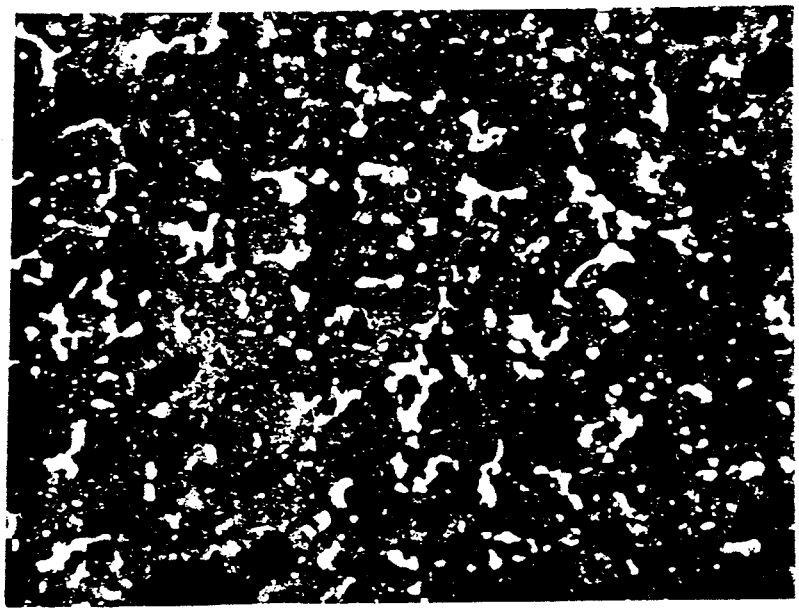
FIG. 1 is photomicrograph of an inventive cam, which has been produced according invention, at a magnification of 200×.
Figure 2:
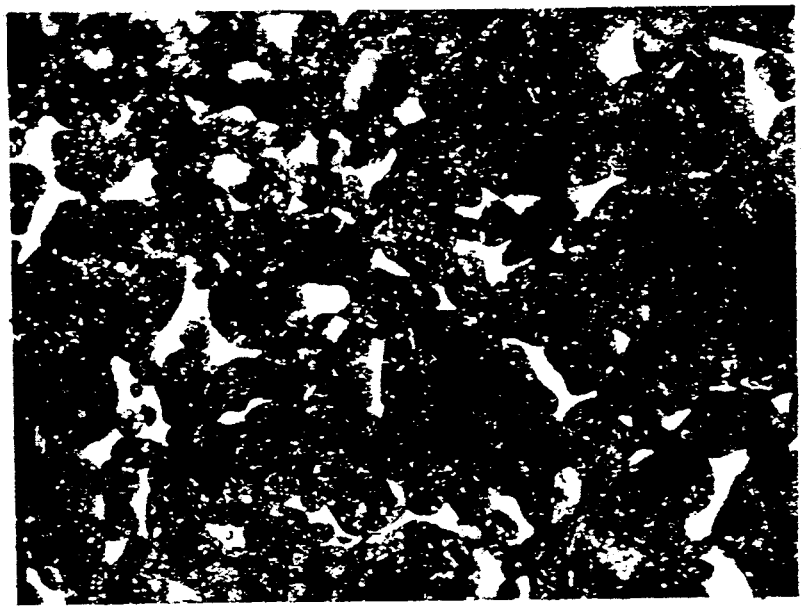
FIG. 2 is a 500× magnification of the same photomicrograph as that of FIG. 1.

The representations of FIGS. 1 and 2 show photomicrographs of an inventive cam which has been produced according to the example described above. FIG. 1 is a 200× magnification; FIG. 2 is a 500× magnification of the same photomicrograph.

The photomicrographs clearly show three phases:

1. martensite (gray)
2. copper (bright)
3. pores (black)

The martensite has a very uniform physical appearance. Inhomogeneities cannot be recognized. This corresponds to expectations, since a prealloyed, already homogenized powder was used.

The copper is present in irregular spots, which are distributed uniformly over the structure. The size of the copper grains is of the order of 10 to 30 microns. The pores are well rounded. Their distribution is bimodal. One size range is of the order of 5 microns, a value normally observed in steels. The second is of the order of 50 microns. The large pores are secondary pores, which are formed by the dissolution of copper.

Individual phases were identified with the help of microhardness measurements. The microhardness of the bright regions was less than 50 Vicker's hardness 0.01. Since the phase was present in a very finely distributed form, the diagonals of the impressions were almost as large as the regions themselves, so that it was not possible to determine the microhardness accurately. The hardness of pure copper is 34 Vicker's hardness (38).

It is therefore certain that the bright regions are copper and not carbide or an alloy of copper and iron or an intermetallic phase of iron and molybdenum. In any case, there ought not to be any doubt about the identity of the pores and the martensite. The martensitic regions in the grain had a hardness of almost 400 Vicker's hardness 0.01. The Vicker's macrohardness 10 was determined to be 372. The hardness values were measured in the grain.

The proportion by volume of undissolved copper was determined with the help of quantitative stereology (point analysis (30)). It was found to be 7.8%. By chemical analysis, the copper content was found to be 7.4% by weight. The density of copper is somewhat higher than that of iron, so that, on the basis of the stereological analysis, the percentage by weight would be somewhat larger. However, within the limits of the measurement error, which is always present, the results from the two analyses can be regarded as identical. This means that the copper is present completely in undissolved form and that the matrix is probably free of copper.

The proportion by volume of pores was also determined stereologically and by means of gravimetric density measurements. The two methods led to the same result, a value of 6.5% being obtained.

Aside from a small proportion of pores, the Fe/1.5Mo/10Cu/0.8C alloy consists of elementary copper and martensite, in which only disappearingly small proportions of copper are dissolved. While the pores at the surface improve the lubrication somewhat, the copper portion, as solid lubricant, serves to improve the emergency running properties. The martensite brings about resistance to abrasive wear.

When partially alloyed powders are used, the forming forces are decreased and the wear of the mold during the production of the molded article is reduced. It is also easier to vary the contents of the alloy. It is, however, also conceivable to use a mixed alloy powder. In this case, however, taking into consideration the diffusion properties of copper and molybdenum, the possibility cannot be excluded that a completely different structure could result, since the copper may then well partially dissolve in the iron, so that the proportion of free, elementary copper in the structure is lowered drastically.

The results achieved by the inventive proposals are surprising even to an expert in this art. On the basis of previous experience, a large portion of the copper contained in the alloy would have to dissolve even after relative short sintering times and low sintering temperatures. Bockstiegel (20) has shown in fundamental work, that the dissolution process at 1150° C. is already completely finished after less than 30 minutes. In agreement with others (36), Bockstiegel states that the solubility is 7.5%. Therefore, if the copper content is 10%, it should be possible to find only 2.5% undissolved copper after adequate sintering. However, quantitative analysis of the alloy has shown that practically the whole of the copper is present in the matrix in undissolved form.

Probably only the molybdenum can be made responsible for this. The insolubility of copper in molybdenum (34) leads to the assumption that molybdenum greatly reduces the solubility of copper in molybdenum (34). If the phase diagram for Fe-Mo is considered, it can be seen that at 2.6% by weight of molybdenum, 1.5% on an atomic basis, at temperatures around 1100° C., the transition from gamma-iron to α-iron takes place. Molybdenum therefore is a very strong α-opener; that is, the steel is preferentially present in the body-centered cubic structure.

The solubility of copper in iron is, however, significantly less in the α-phase than in the face-centered cubic gamma phase. Whereas up to 7.5% by weight dissolve in the gamma iron, the maximum solubility in the α-phase is only 1.4% by weight (36). Owing to the fact that the α-phase is largely stabilized by the molybdenum (1.5% by weight), diffusion of copper into the phase is largely prevented. However, copper evidently is not completely insoluble in Fe-Mo. The diffusion coefficient of copper was measured in the Fe-1% Mo system (37) and leads to the conclusion that a finite solubility of copper exists at least at these small molybdenum concentrations.

The results of the investigation indicate that the correct order of magnitude was selected for the molybdenum content. A content of 0.5% probably is not sufficient to lower the solubility of copper to the degree observed here and therefore appears to be a reasonable lower limit.

If anything, the upper limit is fixed by economic considerations. The molybdenum content is therefore limited to about 16%. At 16% by weight molybdenum, there is departure from the α-region at the sintering temperature (1120° C.), which can lead to a change in the behavior of the alloy. This limit could therefore be named as the upper limit.

The copper content must be selected so that it guarantees the necessary emergency running properties. The lower limit can be set at 1%, since the effect of copper as a solid lubricant is hardly adequate below this limit. As the upper limit, a value must be chosen, at which a sufficient portion of the structure is still present in the form of the hard martensitic matrix, in order to guarantee that the bearing surface remain sufficiently large. One can therefore start out from an order of magnitude of about 20% for the upper limit.

The inventive alloy can be produced only by powder metallurgical means. The special structure, which consists of a martensitic matrix and elementary copper, can be produced directly by the sintering process. In so doing, the exceptionally low solubility of copper in Fe-Mo is utilized. As a result, practically the whole of the copper portion is available as solid lubricant. Moreover, the copper content also does not lead to swelling, as it does in other copper-alloyed materials. It can be assumed that comparable structures are obtained irrespective of whether a mixed or a diffusion alloyed powder is used.

Admittedly, as shown by the state of the art, different metals are known as solid lubricants for sintered materials. However, the use of copper as a solution to the problem of the cam/counter-object system is new. Compared to our own experience, in which the solid lubricant, for example, lead, was introduced into the matrix by impregnation, the inventive alloying has the advantage that the copper is contained in the material from the very start. It is, however, also possible to introduce the copper by impregnating a molded article of low density. Moreover, it is possible to guarantee a uniform distribution of the copper and a fixed copper content. On the other hand, in the case of impregnating, the proportion by volume and the distribution of the copper are determined by the distribution and the size of the open pores. This distribution, however, is more difficult to influence than the size, quantity and distribution of the copper in the powder mixture, so that the reliability of the process is increased in the system introduced here.

Molybdenum very effectively prevents the dissolution of the copper in the matrix, so that the copper can be available as a solid lubricant. A main problem of wear in the cam/counter-object system, namely adhesion, is successfully solved by the use of a solid lubricant. As an additional positive effect, molybdenum prevents the swelling, which is otherwise observed in copper-alloyed materials. By these means, the precision or accuracy of the work is improved and the mechanical properties are improved.

If the inventive advantages are achieved particularly through the use of a prealloyed powder, it is also conceivable that a comparable structure can be produced in the following different way. To begin with, a mixed alloyed Fe-C-Mo powder is consolidated and homogenized by sintering. By choosing a very low green density, open pores, which are closed by impregnating with copper, remain in the structure. A comparable structure can also be produced in this manner. With this variation of the method, it is also possible to start out from a prealloyed powder.

The above considerations, insofar as they relate to the wear properties of cams, are also relevant to other molded articles, which are subjected to wear, such as a drag levers, rocker arms, etc., that is, molded articles exposed to sliding wear.

LITERATURE

[1] Kimura T.: Development of Ferrous Sintered Parts in Japan, Modern Developments in Powder Metallurgy, ed. P. U. Gummeson, D. A. Gustafson 21 (1988) 551-561.

[2] Tanase T., Mayama O., Matsunaga H.: Properties of Wear-Resistant Alloys Having High Volume Fraction of Carbides, Modern Developments in Powder Metallurgy, ed. P. U. Gummeson, D. A. Gustafson 21 (1988) 563-573.

[3] Jahanmir S.: Examination of Wear Mechanisms in Automotive Camshafts, Wear 108 (1986) 235-254.

[4] Isakov A. E. et al: The Optimal Hardness of Camshaft Journals and Cams for Improved Wear-Resistance, Russian Engineering Journal 54, 7 (1974) 38-40.

[5] Isakov A. E. et al: Manufacturing Technology Reduces Camshaft Journal and Cam Wear, Russian Engineering Journal 54, 5 (1974) 49-51.

[6] Eyre T. S., Crawley B.: Camshaft and Cam Follower Materials, Tribology International 13, 4 (1980) 147-152.

[7] Riccio G: The Camshaft, Metallurgical Science and Technology 4, 3 (1986) 96-103.

[8] Reinke F.: Aufbau ledeburitischer Randschichten durch Umschmelzbehandlung von Nocken und Nockenfolgern, VDI-Bericht, Nr. 506 (1984) 67-74.

[9] Werner G. D., Ziese J.: Verbesserung der Verschleissbeständigkeit an Nockenwellen durch gezielte Nitrier- und Oxidierbedingungen, VDI-Berichte, Nr. 506 (1984) 59-62.

[10] Arnhold V., Wähling R: High Performance Components Produced via Vacuum Sintering, Modern Developments in Powder Metallurgy, ed. P. U. Gummeson, D. A. Gustafson 21 (1988) 183-195.

[11] Thümmler F., Oberacker R., Klausmann R.: Sintered Steel With High Carbide Content, Modern Developments in Powder Metallurgy, ed. P. U. Gummeson, D. A. Gustafson 20 (1988) 431-441.

[12] Reinke F.: Örtliches Umschmelzen zum Aufbau verschleissfester ledeburitischer Randschichten an Werkstücken aus Gusseisen, insbesondere Nockenwellen und Nockenfolger, AEG-Elotherm, firmeneigener Bericht 2-15.

[13] Beiss P., Duda D., Wähling R.: Hochverschleissfeste Formteile-Herstellung-Eigenschaften-Anwendungsmöglichkeiten, Krebsöge Information.

[14] Archard J. F.: Contact and Rubbing of Flat Surfaces, Journal of Applied Physics, 24, 8 (1953) 981-988.

[15] Boyer H. E., Gall T. L.: Metals Handbook—Desk Edition, ASM Metals Park, Ohio 1985, 25.10.

[16] Suzuki K., Ikenoue Y., Endoh H., Uchino, M.: New Sintered Valve Seats for Internal Combustion LPG Engines, Modern Developments in Powder Metallurgy, ed. P. U. Gummeson, D. A. Gustafson 21 (1988) 157-170.

[17] Hamiuddin G., Upadhyaya G. S.: Effect of Copper on Sintered Properties of Phosphorus- Containing Ternary Iron Powder Premixes, PMI 14, 1 (1982) 20-24.

[18] Lindskog P., Carlsson A.: Sintered Alloys Based on Sponge Iron Powder with Additions of Ferrophosphorus, PMI 4, 1 (1972) 39-43.

[19] Dautzenberg N., Dorweiler H. J.: Dimensional Behaviour of Copper-Carbon Sintered Steels, PMI 17, 6 (1985) 279-281.

[20] Bockstiegel G.: Erscheinungsbild und Ursachen von Volumenänderungen beim SIntern von Prelingen aus Eisen-Kupferund Eisen-Kupfer-Graphit-Pulvermischungen, Stahl und Eisen 79, 17 (1959) 1187-1201.

[21] Esper F. J., Friese K. H., Zeller, R.: Sintering Reactions and Radial Compressive Strength of Iron-Tin and Iron-Copper-Tin Powder Compacts, International Journal of Powder Metallurgy 5, 3 (1969) 19-31.

[22] Wegst W.: Stahlschlüssel, Verlag Stahlschlüssel Wegst GmbH, Marbach 1989, 4.

[23] Biggiero G., Borruto A., Ercolani D.: Influence of the Addition of Copper on the Wear Resistance of Sintered Ferrous Materials, Horizons of Powder Metallurgy, ed. W. A: Kaysser, W. J. Huppmann (1986) 1289-1295.

[24] Hamiuddin M.: Wear Behaviour of Sintered Phosphorus Containing Ternary Iron Alloy Powder Compacts, PMI 17, 1 (1985) 20-22.

[25] Fischmeister H.: Improvements Relating to Tough Material for Tools and/or Wearing Parts, Patent GB2157711A, UK 4. April 1985.

[26] Chen L. H., Rigney D.A.: Transfer During Unlubricated Sliding Wear of Selected Metal Systems, Wear of Materials, ed. K. C. Ludema ASME (1985) 437-446.

[27] Sheasby J. S., Mount G. R., Elder J. E.: Direct Observation of the Wear of Copper, Wear of Materials, ed. K. C. Ludema ASME (1985) 545-549.

[28] Sasada T., Norose S.: The Dependence of Wear Rate on Sliding Velocity and Sliding Distance for Dry Cu/Fe and Ni/Fe, Wear of Materials, ed. K. C. Ludma ASME (1985) 432-436.

[29] Reid J. V., Schey J. A.: Adhesion of Copper Alloys, Wear of Materials, ed. K. C. Ludema ASME (1985) 550–557.
[30] Underwood E. E.: Quantitative Stereology, Addison-Wesley (1970)
[34] Hansen M.: Constitution of Binary Alloys, Mc Graw-Hill New York 1958, 600.
[36] wie [34], S. 580.
[37] N.N.: Diffusion Data 4 (1970) 424.
[38] Samsonov G. V.: Handbook of the Physiochemical Properties of the Elements, IFI/Plenum New York 1968, 303.

We claim:

1. A method for the manufacture of molded articles, including a cam for a camshaft of internal combustion engines which is assembled according to the modular principle, comprising pressing sintering powder of 0.5 to 16% by weight of molybdenum, 1 to 20% by weight copper, 0.1 to 1.5% by weight carbon and, optionally, admixtures of chromium, manganese, silicon and nickel totalling at most 5% by weight, the remainder being iron, into a molded cam with a green density of more than 7 g/cc, sintering the molded cam at a temperature below 1150° C. during a sintering period of 10 to 60 minutes and subsequently hardening and tempering the sintered cam.

2. The method of claim 1, in which the sintering powder is comprised of a prealloyed iron-molybdenum powder.

3. The method of claim 2, in which the sintering powder is prepared by mixing copper with the prealloyed iron-molybdenum powder.

4. The method of claim 1, in which the carbon is introduced by mixing graphite with the sintering powder.

5. The method of claim 3, in which the carbon is introduced by mixing graphite with the sintering powder.

6. The method of claim 1, in which the carbon is introduced at least partly by means of a carburizing atmosphere during the sintering and/or during the hardening.

7. The method of claim 3, in which the carbon is introduced at least partly by means of a carburizing atmosphere during the sintering and/or during the hardening.

8. A method for the manufacture of molded articles, including a cam for a camshaft of internal combustion engines which is assembled according to the modular principle, comprising preparing an alloy having a hardened matrix with interstitial copper, wherein the alloy consists of 0.5 to 16% by weight of molybdenum, 1 to 20% by weight of copper, 0.1 to 1.5% by weight of carbon and, optionally, admixtures of chromium, manganese, silicon and nickel totalling at most 5%, by consolidating sintering powder selected from partially alloyed or mixed alloyed iron-molybdenum powder, optionally containing carbon, homogenizing the consolidated sintering powder by sintering to produce an article with open pores, hardening, tempering and introducing copper into the open pores of the article by impregnation, with the proviso that the carbon is introduced into the sintering powder or the carbon is introduced by means of a carburizing atmosphere during sintering and/or hardening or the carbon is introduced by a combination thereof.

9. The method of claim 8, in which carbon is introduced by mixing graphite with the sintering powder.

10. The method of claim 8 in which the mixed alloyed iron-molybdenum powder contains carbon.

11. The method of claim 8, in which the carbon is introduced partly or completely by means of a carburizing atmosphere during sintering, hardening or a combination thereof.

12. A method for the manufacture of molded articles, including a cam for a camshaft of internal combustion engines which is assembled according to the modular principle, comprising preparing an alloy having a hardened matrix with interstitial copper, wherein the alloy consists of 0.5 to 16% by weight of molybdenum, 1 to 20% by weight of copper, 0.1 to 1.5% by weight of carbon and, optionally, admixtures of chromium, manganese, silicon and nickel totalling at most 5%, by pressing sintering powder of 0.5 to 16% by weight of molybdenum, 1 to 20% by weight copper, optionally 0.1 to 1.5% weight carbon and, optionally, admixtures of chromium, manganese, silicon and nickel totalling at most 5% by weight, the remainder being iron, into a molded cam with a green density of more than 7 g/cc, sintering the molded cam at a temperature below 1150° C. during a sintering period of 10 to 60 minutes and subsequently hardening and tempering the sintered cam, with the proviso that the carbon is introduced into the sintering powder or carbon is introduced partly or completely by means of a carburizing atmosphere during sintering, hardening or a combination thereof.

* * * * *

UNITED STATES PATENT AND TRADEMARK OFFICE

CERTIFICATE OF CORRECTION

PATENT NO. : 5,082,433

DATED : January 21, 1992

INVENTOR(S) : Karl Leithner

It is certified that error appears in the above-identified patent and that said Letters Patent is hereby corrected as shown below:

Title page, item [73] Assignee: should read as follows:

--Etablissement Supervis
Fl-9490 Vaduz
Fürstentum Liechtenstein--.

Signed and Sealed this

Twenty-fifth Day of May, 1993

*Attest:*

Michael K. Kirk

MICHAEL K. KIRK

*Attesting Officer*

*Acting Commissioner of Patents and Trademarks*